United States Patent [19]

Schneider et al.

[11] B 4,013,002

[45] Mar. 22, 1977

[54] PROCESS AND APPARATUS FOR ACTUATING THE RAM WEIGHT COMPENSATION MECHANISM OF A PRESS

[75] Inventors: Franz Schneider; Burkhard Schumann, both of Goppingen, Germany

[73] Assignee: L. Schuler GmbH, Germany

[22] Filed: Mar. 24, 1975

[21] Appl. No.: 561,165

[44] Published under the second Trial Voluntary Protest Program on March 30, 1976 as document No. B 561,165.

[30] Foreign Application Priority Data

Mar. 26, 1974 Germany ..... 2414409

[52] U.S. Cl. ..... 100/35; 100/48; 100/53; 100/259

[51] Int. Cl.[2] ..... B30B 13/00

[58] Field of Search ..... 100/48, 53, 35, 259, 100/DIG. 18; 192/12 R

[56] References Cited

UNITED STATES PATENTS 2,784,665 3/1957 Georgeff ..... 100/259 X 3,115,086 12/1963 Stimmel ..... 100/48

FOREIGN PATENTS OR APPLICATIONS 1,348,627 3/1974 United Kingdom ..... 100/259

*Primary Examiner*—Billy J. Wilhite

*Attorney, Agent, or Firm*—Craig and Antonelli

[57] ABSTRACT

A process and apparatus for the positive actuation of a weight compensating mechanism for a ram of a press accommodating a tool set. The process includes the detecting of at least one condition indicative of the changing of a tool set of the press, preventing working operation of the press in response to such detected condition, and then initiating operation of the weight compensating mechanism. The process also includes the enabling of the working operation of the press upon completion of the weight compensating operation. The apparatus for carrying out the process includes at least one signal generator for providing an output indicative of the changing of a tool set, a device for preventing working operation of the press in response to the detection of such condition and a control arrangement for initiating operation of the weight compensating mechanism in accordance with sensed conditions of the press.

21 Claims, 1 Drawing Figure

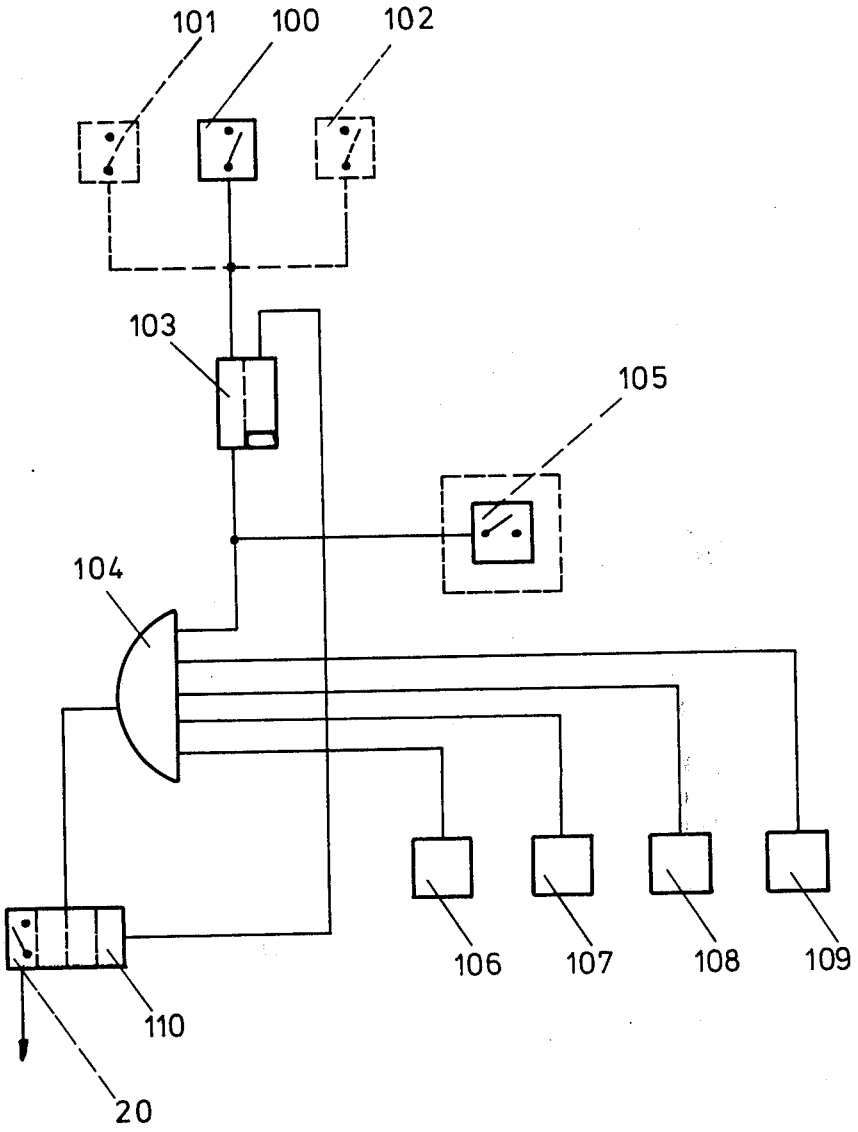
101
100
102
103
105
104
106
107
108
109
110
20

PROCESS AND APPARATUS FOR ACTUATING THE RAM WEIGHT COMPENSATION MECHANISM OF A PRESS

The present invention relates to a process and apparatus for the positive actuation of a weight compensating mechanism for the ram associated with an upper die of a press.

In case of presses of the type disclosed in British Pat. No. 1,348,627 or U.S. Pat. No. 3,115,086 having devices for compensating for the weight of the ram with upper die, equipped with an automatic device for adjusting the value required for counterbalancing the weight of the ram with upper die, for example to adjust the gas pressure in a cylinder-piston unit, there is the danger that the press is set in operation if the weight compensating mechanism for the ram with upper die is not correctly set. The incorrect setting is primarily due to the fact that the operator intentionally or inadvertently omits the operation of this automatic mechanism, which result in disturbances in the working process of the press or damage to the press.

Therefore, it is an object of the present invention to provide a process and apparatus by means of which the device for setting the correct value for the weight compensation mechanism is operated independently of the operator's will.

The present invention starts with the realization that this apparatus must be actuated if the tool set used in the press has been changed, since this results practically in all cases in an alteration of the weight to be counterbalanced. Accordingly, the invention is based on the consideration that it is necessary to positively detect the changing of the tool set and, in dependence thereon, to positively actuate the device for setting the correct value.

On the one hand, the operation of the ram adjusting mechanism of the press is a step indicating a tool set change, because an actuation of the ram adjusting mechanism is required for extending the tool set out of the press working zone and for moving the tool holding plate toward the tool set for mounting one of the tools. On the other hand, the introduction of at least one support die into the press working zone is also a step indicating a tool set change, because at least one support die must be utilized for safety reasons during a tool set change while operating within the press working zone. Furthermore, the at least one-time switching of a sensor switch at the press table or at a tool holding plate is a step indicating a tool set change, because such a sensor switch is operated only if a tool is detached from the tool holding plate or from the press table or if a tool is attached thereto. Finally, the separation of at least one plug-in connection to the tool set, serving for feeding current to at least one tool of the tool set, is a step indicating a tool set change, because only during such a procedure is there a need for severing such plug-in connections. In accordance with the present invention, the various abovedescribed steps can be utilized individually or in combination to effect the positive actuation of the device for setting the correct value.

In accordance with a feature of the present invention, a blocking mechanism is actuated which serves for preventing the engagement of the clutch and the release of the brake for the working operation. It is understood that such a blocking mechanism still makes it possible, if necessary, to move the drive into a predetermined position, e.g. upper dead center, for example in slow motion or at reduced speed or with a reduced transmittable torque as is known in the art. In this predetermined position, the setting of the correct value for the weight compensating mechanism is to be effected. However, the blocking mechanism must make it impossible to conduct operating strokes of the press by a corresponding influence on the clutch and brake.

According to the present invention the method may be effected by providing a switching arrangement, for example, at a press, wherein the operation of the ram adjusting mechanism or one of the other aforementioned operations, actuates a bistable flip-flop connected on the output side with an input of an AND gate circuit and with a switch for actuating the blocking mechanism and maintains same. The other inputs of the AND gate circuit are connected to signal generators for the existence of the remaining conditions. The output of the AND gate circuit controls the stepping or control mechanism for the weight compensating mechanism and sets the same in operation. After an operating cycle of the stepping or control mechanism has been completed, the flip-flop is reset, whereby the blocking mechanism is deactivated. Thereafter, it is possible for the press to execute working strokes triggered automatically or arbitrarily.

These and further objects, features, and advantages of the present invention will become more apparent from the following description when taken in connection with the accompanying drawing which shows, for purposes of illustration only, one embodiment in accordance with the present invention, and wherein:

the single FIGURE is a block diagram of a control system for actuating the ram weight compensation mechanism of a press.

Referring now to the single FIGURE, the control system of the present invention includes at least one signal generator 100, 101 and 102 wherein the signal generator 100, for example, provides an output in response to a tool change of the press, the signal generator 101 provides an output in response to the operation of the ram adjusting mechanism, and the signal generator 102 provides an output in response to the introduction of at least one support die into the press working zone. Alternatively, the signal generators may be individually triggered in response to the switching of a sensor switch at the press table or at a tool holding plate or the separation of at least one plug-in connection to the tool set. As shown, the signal generators are connected to a bistable multivibrator or flip-flop 103 whereby the output from any one of the signal generators serves for setting the flip-flop 103 so as to provide an output therefrom. The output of the flip-flop 103 is applied to one input of an AND gate 104 and to a switch device 105 of a blocking mechanism. The switching device is arranged to actuate the blocking mechanism so that operation of the press is prevented. The switching device 105 may be connected, for example, in the circuit of the operating elements such as electromagnets of the pressure medium valves which operate the brake and clutch mechanisms of the press. Accordingly, operation of the switch device 105 of the blocking mechanism when the flip-flop 103 provides an output, results in activation of the blocking mechanism so as to engage the brake and prevent engagement of the clutch. Suitable control circuits for a clutch and brake of a press or similar mechanism are disclosed in U.S. Pat. No. 2,816,635 and 2,939,973. As disclosed in such patents, appropriate operation of the clutch and brake controls may be effective to engage a brake and cause disengagement or relieving of a clutch.

The control circuit as illustrated in the FIGURE also includes signal generators 106, 107, 108, 109 each of which is connected with a respective input of the AND gate 104. The signal generators serve for sensing the conditions necessary for actuating the ram weight compensation device. For example, the signal generator 106 may be arranged for sensing the condition that the selector switch is in operating position and for providing an output in response to such sensed condition. The selector switch is generally a manually operated switch having a plurality of positions including an off position and at least one operating position. The signal generator 107 may be responsive to the condition that the ram is in the upper dead center position, i.e. the drive is in a predetermined position, whereas the signal generators 108 and 109 may be responsive to the conditions that the clutch is relieved or disengaged and that the brake is engaged, respectively. Here again, the signal generators 107 to 109 provide an output to the AND gate 104 in response to the sensed condition. Alternatively, the signal generators 107 or other of the signal generators may be utilized to sense other conditions such as the ram adjusting mechanism has been operated, the support die has been inserted a sensor switch has been operated or a plug-in connection has been severed with such sensed condition being preferably utilized with one or more of the other indicated sensed conditions for control purposes. It is noted that signal generators 100–102 and 106–109 may be constructed in a manner known in the art so as to be responsive to appropriately sensed conditions. When each of the signal generators 106–109 has sensed the appropriate condition and has generated an output which is delivered to the AND gate 104, the AND gate in response to the simultaneously applied input signals provides an output which activates a stepping or control mechanism 110 which may include a switch mechanism 20 for initiating a ram weight compensation device of the type disclosed for example in British Pat. No. 1,348,627, U.S. Pat. No. 3,115,086 or in the commonly assigned copending application by Eugen Waller, Rolf Kellenbenz, Burkhard Schumann, Wolfram Buchler and Franz Schneider, Ser. No. 561,166 entitled "Press With Hydraulic Overload Safety Device and Ram Weight Counterbalancing Mechanism", filed on even date with this application, the subject matter of the copending application being incorporated herein.

Upon completion of the operating cycle in which the ram weight is compensated, this completion is sensed by the stepping or control mechanism 110 and such mechanism provides an output for resetting the flip-flop 103 which in turn causes the switching over of the switch device 105 of the blocking mechanism. Accordingly, the brake is disengaged and the clutch may be engaged whereby the press is now ready again for operation. It is noted that the completion of the weight compensating operation may be sensed in a conventional manner or, for example, may be sensed in the manner as disclosed in the copending application whereby upon completion of the compensation operation, the flip-flop 103 is reset so as to enable further operation of the press.

While we have shown and described one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A process for the positive actuation of a weight compensating mechanism for a ram of a press comprising the steps of detecting at least one condition indicative of the changing of a tool set of the press, preventing working operation of the press in response to the detection of a condition indicative of the changing of a tool set, and subsequently initiating operation of the weight compensating mechanism for the ram of the press.

2. A process according to claim 1, further including the step of enabling the working operation of the press upon completion of the weight compensating operation.

3. A process according to claim 2, including prior to initiating operation of the weight compensation mechanism, the step of sensing at least one condition of the press and initiating the operation of the weight compensation mechanism in response to the sensed condition.

4. A process according to claim 3, wherein the step of sensing includes sensing at least one condition indicative of the prevention of the working operation of the press and sensing at least one condition indicative of the change of a tool set, and initiating operation of the weight compensating mechanism in response to the sensed conditions.

5. A process according to claim 4, wherein the step of preventing a working operation of the press includes activating a blocking mechanism for engaging a brake of the press and for disengaging a clutch of the press.

6. A process according to claim 5, wherein the step of detecting at least one condition of the changing of a tool set of the press includes the detecting of at least one of operating of a ram adjusting mechanism, insertion of at least one support die in the press working zone, at least one-time switching of at least one sensor switch at the press table or at a tool holding plate, and at least one-time severing of at least one plug-in connection to the tool set which provides an electrical connection to the tool set.

7. A process according to claim 6, wherein the step of sensing includes sensing a condition indicative of the drive being in a predetermined position, sensing the brake being engaged, sensing the clutch being disengaged, sensing a selector switch of the press being in operating position, and sensing a condition indicative of the change of the tool set, the operation of the weight compensating mechanism being initiated in response to the sensing of the sensed conditions.

8. A process according to claim 7, wherein the sensing of a condition indicative of the change of the tool set includes the sensing of one of the ram adjusting mechanism has been operated, a support die has been inserted into the working zone of the press, a sensor switch has been operated, and a plug-in connection has been severed.

9. A process according to claim 8, wherein the operation of the weight compensating mechanism includes setting a gas pressure value necessary for compensating for the weight of the ram associated with an upper die of the press.

10. A process according to claim 9, wherein the step of enabling the working operation of the press upon completion of the weight compensating operation includes deactivating the blocking mechanism for enabling the engagement of the clutch and for enabling of the disengagement of the brake.

11. A process according to claim 8, wherein the step of detecting includes detecting the operating of a ram adjusting mechanism and the step of sensing includes sensing that the ram adjusting mechanism has been operated.

12. A process according to claim 8, wherein the step of detecting includes detecting insertion of at least one support die in the press working zone and the step of sensing includes sensing a support die has been inserted.

13. A process according to claim 8, wherein the step of detecting includes detecting the at least one-time switching of at least one sensor switch and the step of sensing includes sensing a sensor switch has been operated.

14. A process according to claim 8, wherein the step of detecting includes detecting the at least one-time severing of at least one plug-in connection to the tool set and the step of sensing includes sensing a plug-in connection has been severed.

15. Apparatus for the positive actuation of a weight compensating means for a ram of a press accommodating a tool set comprising detecting means for detecting the changing of a tool set and providing an output indicative thereof, preventing means responsive to the detection of the changing of the tool set for preventing a working operation of the press, and initiating means responsive to the detection of the changing of the tool set and the preventing of a working operation of the press for initiating operation of the weight compensating means.

16. Apparatus according to claim 15, further comprising resetting means responsive to the completion of the weight compensating operation for enabling the working operation of the press.

17. Apparatus according to claim 16, wherein said detecting means includes at least one detecting signal generator means responsive to a condition indicative of the changing of a tool set for providing an output signal, said preventing means includes setting means responsive to the output from said at least one detecting signal generator means for providing an output signal and switching means responsive to the output signal of said setting means for activating a blocking means for preventing the working operation of the press, said initiating means includes at least one sensing signal generator means for sensing at least one condition of the press and providing an output indicative thereof, gating means responsive to the output of said setting means and said at least one sensing signal generator means for providing an output signal, and actuating means responsive to the output of said gating means for initiating operation of the weight compensating means, and said resetting means being responsive to the completion of the operation of the weight compensating means for resetting said setting means whereby said switching means deactivates the blocking means and enables working operation of the press.

18. Apparatus according to claim 17, wherein said blocking means serves for engaging a brake of the press and disengaging a clutch of the press, and wherein a plurality of sensing signal generator means is provided, said plurality of sensing signal generator means including a first sensing signal generator means being responsive to the condition that the drive is in a predetermined position for providing an output signal, a second sensing signal generator means being responsive to the condition that the brake is engaged for providing an output signal, a third sensing signal generator means being responsive to the condition that the clutch is engaged for providing an output signal, a fourth sensing signal generator means being responsive to a selector switch of the press being in operating position for providing an output signal, and a fifth sensing signal generator means being responsive to a condition indicative of the change of the tool set for providing an output signal, said gating means being an AND gate for receiving the outputs from said first, second, third, fourth and fifth sensing signal generator means and from said setting means for providing an output signal.

19. Apparatus according to claim 18, wherein said fifth sensing signal generator means is responsive to a condition indicative of one of the ram adjusting mechanism has been operated, a support die has been inserted in the working zone of the press, a sensor switch at the press table or at a tool holding plate has been operated, and a plug-in connection which provides an electrical connection to the tool set has been severed.

20. Apparatus according to claim 19, wherein said at least one detecting signal generator means is responsive to the detection of one of operating of a ram adjusting mechanism, insertion of at least one support die in the press working zone, at least one-time switching of at least one sensor switch, and at least one-time severing of at least one plug-in connection to the tool set.

21. Apparatus according to claim 20, wherein a plurality of detecting signal generator means is provided, each of said detecting signal generator means being responsive to a different condition indicative of the changing of the tool set for providing an output signal and said setting means is a flip-flop for providing an output in response to an output from at least one of said detecting signal generator means.

* * * * *